United States Patent [19]

Langner

[11] Patent Number: 4,616,707

[45] **Date of Patent: * Oct. 14, 1986**

[54] RISER BRAKING CLAMP APPARATUS

[75] Inventor: Carl G. Langner, Spring, Tex.

[73] Assignee: Shell Oil Company, Houston, Tex.

[ * ] Notice: The portion of the term of this patent subsequent to Oct. 8, 2002 has been disclaimed.

[21] Appl. No.: 720,841

[22] Filed: Apr. 8, 1985

[51] Int. Cl.[4] ..... E21B 19/09

[52] U.S. Cl. ..... 166/345; 166/353; 166/355; 166/367

[58] Field of Search ..... 166/345, 352, 353, 354, 166/355, 362, 367; 188/67; 81/57.16, 57.34, 57.36, 57.2; 248/316.4, 316.2, 316.3, 316.1, 231.3, 231.4, 410, 414, 561; 285/18, 96, 97

[56] References Cited

U.S. PATENT DOCUMENTS

| | | | |
|---|---|---|---|
| 3,717,002 | 2/1973 | O'Brien et al. | 166/345 |
| 3,771,389 | 11/1973 | Coyne | 81/57.16 |
| 3,860,270 | 1/1975 | Arnold | 285/96 |
| 4,456,070 | 6/1984 | Watkins | 166/345 |
| 4,527,817 | 7/1985 | Persson | 285/96 |
| 4,545,437 | 10/1985 | Denison | 166/345 |

*Primary Examiner*—Stephen J. Novosad
*Assistant Examiner*—William P. Neuder

[57] ABSTRACT

Apparatus for use in drilling a well from a floating vessel by means of a riser which connects the vessel's drilling equipment to a wellhead assembly adjacent the ocean floor. The riser is capable of being disconnected from the wellhead assembly and having the motion of its upper end arrested and subsequently secured to the vessel. The present riser braking clamp apparatus comprises braking elements integrally carried by the telescoping joint located at the upper end of the riser. Actuation of these braking elements prevents further telescopic movement of the telescopic joint, thereby preventing movement of the riser upper elements relative to the vessel.

9 Claims, 5 Drawing Figures

10
9
8
12
5
5 A
6
6A
II
II
25
23
23A
24
11
7
1
14
15
2
16
4
19
V
17
18
20
21
V
13
V
22
3

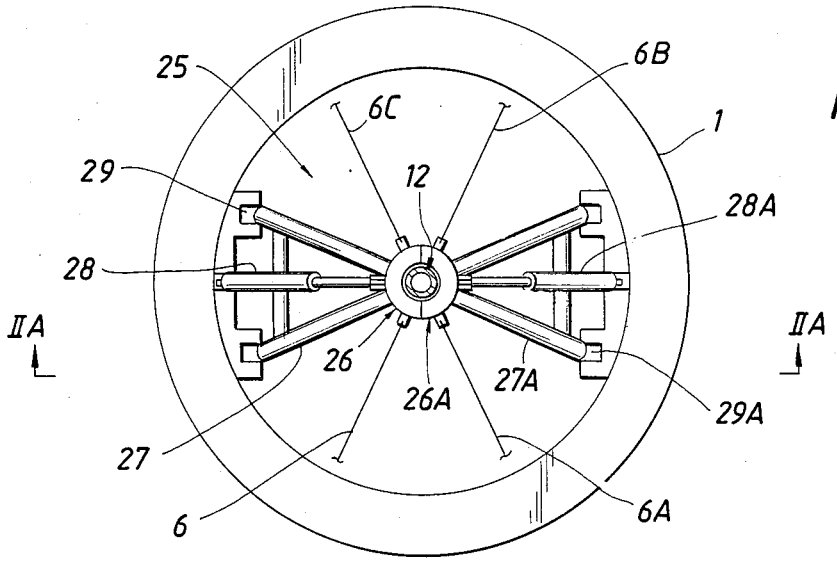
FIG. 2
FIG. 2A
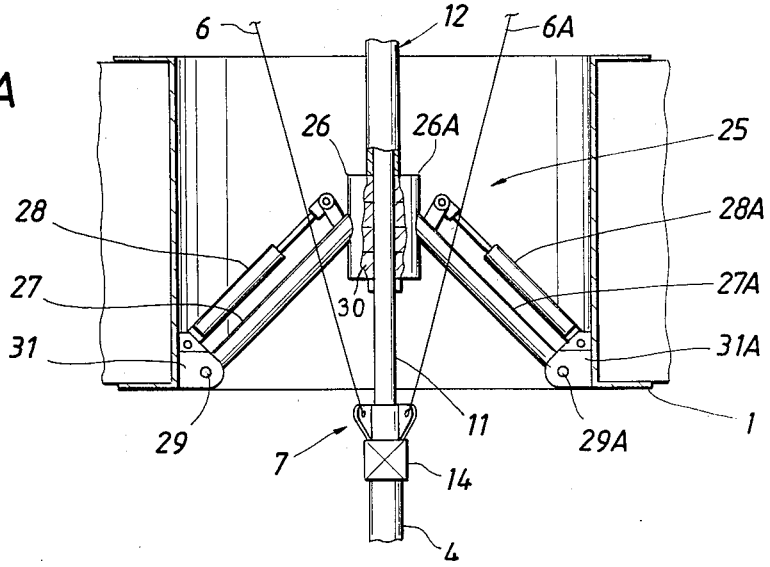
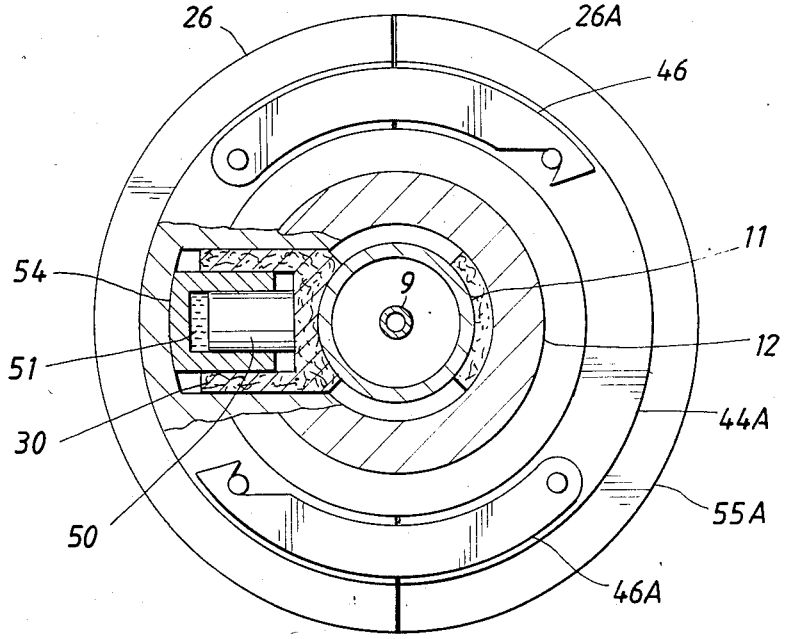
FIG. 3A

RISER BRAKING CLAMP APPARATUS

RELATED APPLICATION

This application is related to three copending applications, two entitled "Drilling Riser Locking Apparatus and Method", Ser. No. 597,994 and 597,995, both filed Apr. 9, 1984, the third application entitled "Drilling Riser Braking Apparatus and Method", Ser. No. 720,842, filed Apr. 8, 1985.

BACKGROUND OF THE INVENTION

1. Field of the Invention

The present invention relates to apparatus and method for drilling a well into earth formations lying below a body of water, wherein the wellhead equipment of the well is positioned below the surface of the water. The well is drilled from a floating drilling vessel, with a riser conduit connecting the vessel drilling equipment to the wellhead assembly.

2. Description of the Prior Art

An increasing amount of offshore deepwater exploratory well drilling is being conducted in an attempt to locate oil and gas reservoirs. These exploratory wells are generally drilled from floating vessels. As in any drilling operation, drilling fluid must be circulated through the drill bit in order to cool the bit and to carry away the cuttings. This drilling fluid is normally returned to the floating vessel by means of a large diameter pipe, known as a riser, which extends between the subsea wellhead assembly and the floating vessel. The lower end of this riser is connected to the wellhead assembly which is generally located adjacent the ocean floor, and the upper end usually extends through a centrally located hull opening of the floating vessel. A drill string extends downward through the riser into earth formations lying below the body of water, and drilling fluids circulate downwardly through the drill string, out through the drilling bit, and then upwardly through the annular space between the drill string and the riser, returning to the vessel.

As these drilling operations progress into deeper waters, the length of the riser and consequently its unsupported weight also increases. Since the riser has the same structural buckling characteristics as a vertical column, riser structural failure may result if compressive stresses in the elements of the riser exceed the metallurgical limitations of the riser material. Two separate mechanisms are typically used to avoid the possibility of this cause of riser failure.

Riser tensioning systems are installed onboard the vessel, which apply an upward force to the upper end of the riser, usually by means of cable, sheave, and pneumatic cylinder mechanisms connected between the vessel and the upper elements of the riser.

In addition, buoyancy or ballasting devices may also be attached to the submerged portion of the riser. These devices are usually comprised of syntactic foam or individual ballast or buoyancy tanks formed on the outer elements of the riser section. The ballast or buoyancy tanks are capable of being selectively inflated with air by utilization of the floating vessel's air compression equipment. Both of these buoyancy devices create upwardly directed forces in the riser, compensating for the compressive stresses created by the riser's weight, and thereby prevent riser failure.

Since the riser if fixedly secured at its lower end to the wellhead assembly, the floating vessel will move relative to the upper end of the riser due to wind, wave, and tide oscillations normally encountered in the marine environment.

This creates a problem because the portion of the stationary riser located within the hull opening of the oscillating vessel can contact and damage the vessel, unless it remains safely positioned within the hull opening. For this reason motion compensating equipment incorporated with the riser tensioning system is used to steady the riser within the hull opening, and usually takes the form of hydraulically actuated cable and sheave mechanisms connectably engaged between the upper riser elements and the vessel structure, and a flexible coupling located in the riser adjacent the vessel's hull. This equipment allows the vessel to heave and sway, without contacting the upper elements of the riser.

Directional positioning thrusters, in addition to the normal maneuvering system of the vessel, compensate for normal current and wind loading, and prevent riser separation due to the vessel being pushed away from the wellhead location.

All of these systems, however, can only prevent riser compressive failure, separation, or contact with the vessel during normal sea state conditions, or during normal operation of the dynamic positioning system.

The capacity of these systems may be exceeded by high winds and/or swells, which may occur during storms, or by failure of the vessel's dynamic positioning system which causes the vessel to "drive" off its normal position over the well. During either of these situations, measures need to be taken to prevent damage to the vessel and riser.

To avoid damage during a storm, the riser may be disassembled in sections and stowed on the floating vessel's deck, but the time required for this operation usually exceeds the warning time given by an oncoming storm, and certainly would not be sufficient in the event of an "instantaneous" positioning system failure, where the vessel drives uncontrollably off the well location.

An an alternative to disassembly of the riser, the riser may be disconnected from the wellhead assembly and thereby become suspended from the vessel. The vessel with the suspended riser then may remain in the vicinity of the wellhead assembly, or the vessel may attempt to tow the riser out of the path of an approaching storm. In either situation, once the riser's lower element is released from the wellhead assembly, the riser becomes a vertically oriented submerged vessel with its own oscillatory heave characteristics, or "bobbing" tendencies, typically different than those of the supporting vessel. When the riser, which may be under considerable tension from the tensioning system on the vessel, is released abruptly from the wellhead assembly, the riser may accelerate upward with the result that the upward movement of the riser often may exceed the displacement limits of the riser tensioning system. Also, when the vessel and disconnected riser heave upward, due to the vessel riding the crest of a wave, the riser may continue upward while the vessel is falling downward in a subsequent wave trough. This uncontrolled upward riser movement and subsequent downward movement through the center of the hull opening can exceed the allowable vertical movement and load capacity of the normal motion compensating and tensioning equipment, causing severe damage to the vessel and riser, with attendant risk to crew and vessel. A means is needed to prevent this uncontrolled riser movement.

As described in the two related copending applications both entitled "Drilling Riser Locking Apparatus and Method", filed Apr. 9, 1984, apparatus is disclosed which locks the upper end of the drilling riser to the vessel. This eliminates vertical and lateral movement of the riser relative to the vessel, obviating the above problem. The disclosed related apparatus is comprised of riser locking apparatus carried within the hull opening of the floating vessel adjacent the bottom of the vessel. The riser locking apparatus is carried at this lower elevation so that the angular displacement of the riser at its upper flexible coupling will not cause the riser, in its displaced position, to contact and damage the vessel's hull. The riser locking apparatus disclosed in both of these copending applications comprises a pair of movable beams that can be moved toward each other, at the closest point of travel engaging the upper elements of the riser. Locking these beams in their closed position effectively locks the riser's upper end to the vessel, thereby preventing the upper end of the riser from contacting the vessel.

In both of these copending applications, however, proper alignment of the riser with the locking beams in either the vertical or horizontal plane is necessary before the riser may be locked in position. For example, in copending application Ser. No. 597,994, vertical movement of the riser must be stopped before the movable beams can be closed. In copending application Ser. No. 597,995, the riser must be held in position in the center of the vessel's moon-pool before the riser can be raised between the movable beams and subsequently latched in place.

In both situations oscillation of the riser must be damped by devices other than the locking device, prior to the riser's being locked in place. Riser positioning means separate from the oscillation damping means must also be used. The operation of all of the above position and oscillation damping equipment requires close coordination and concentration by the vessel's crew, often during times of adverse sea conditions or in response to unexpected failure of the vessel's directional positioning system.

A device is needed therefore which combines the riser position and oscillation damping function in one device. Such a device is set forth in a copending application, Ser. No. 720,842, entitled "Drilling Riser Braking Apparatus and Method", filed Apr. 8, 1985. The riser braking apparatus disclosed in this third application comprises brake elements mounted at the end of beams which pivot within the hull opening of the vessel. As the beams pivot, the brake elements arc toward the center of the hull opening of the drilling vessel, contact the riser, centralize the riser within the hull opening, and arrest and lock the riser's upper elements to the vessel. This device therefore combines riser position and oscillation damping functions in one device. The proper operation of this device, however, requires that all of the brake elements interlock together after contact with the riser, so as to form a strong, unitized circular structure about the riser.

As may be imagined, every time the riser impacts the brake elements as they arc into position on the pivot beams, the likelihood of deformation of one or all of the pivot beams exists. Sufficient beam deformation may prevent interlock of the brake elements about the riser, which may prevent proper operation of this device.

A device is needed therefore that positions and arrests the riser centrally within the hull opening of the vessel, yet is not as susceptible to damage from riser impact loads during the riser arrestation process.

SUMMARY OF THE INVENTION

The present apparatus continues to incorporate riser positioning, oscillation damping, and riser locking means in one device, thereby simplifying the riser locking process; yet it is not as susceptible to riser impact loads.

The apparatus of the present invention comprises telescopic joint means having a first member and a second member, the lower end of the first member operatively connected to the upper end of the riser, the upper end of the second member operatively connected to the vessel, the first member slideably engaged with the second member, and brake means carried by one member, operatively and selectively engageable with the other member of the telescopic joint means; to dampen, arrest, and prevent further movement of the first member relative to the second member of the telescopic joint means.

In operation, as the riser is being prepared for disconnection from the wellhead assembly, the brake means are actuated to dampen relative movement between the members of the telescopic joint means. Since the telescopic joint members are connected between the riser and the vessel, actuation of the brake means arrests the movement of the riser relative to the vessel. As the riser is released from the subsea wellhead assembly, vertical oscillations are dampened by the brake means. Further brake application locks the riser upper elements relative to the vessel. Heat generated by friction during the braking process is dissipated into the surrounding ocean water, if the device is mounted below the waterline of the vessel. Or, the heat may be dissipated by auxiliary water cooling systems or by air cooling.

One advantage of the present invention is that the brake system is integrated with the riser structure, a design which results in a more compact apparatus than those previously available. Since in the apparatus of the present invention the brake structure is already assembled about the riser, final alignment and interlock of the brake elements is not necessary prior to proper operation of this device.

A further advantage of the present invention is that riser loads may be carried into the ship's structure primarily by tension/compression stresses if supporting beams are used to transfer these loads to the vessel structure, a load transfer feature inherently more efficient than the bending action of the beam structures disclosed in the two copending applications, Ser. No. 597,994 and Ser. No. 597,995.

Another advantage of the present invention is that movements of the riser are at all times controllable and therefore no longer present a threat to the drilling vessel or its crew.

This invention may be used to safely transport the riser away from the current drilling location in order to avoid a marine storm environment; it may be used to transport the riser from one wellhead assembly to another prior to performing normal drilling operations; it may be used during maintenance operations on the vessel's motion compensating and riser tensioning equipment, or it may be used to suspend the riser from the vessel for an indeterminate length of time, either during normal operations or during an emergency disconnect due to failure of the directional positioning system.

Accordingly, it is an object of the invention to provide an offshore vessel with a riser brake clamp apparatus to dampen relative movements between the vessel and the riser, and then to securely lock the upper end of the riser to the vessel, thereby preventing relative motion between the upper end of the suspended riser and the vessel.

Another object is to provide a means of safe disconnection of a riser from a wellhead assembly, such that motions of the riser following disconnection do not pose a threat to the vessel or its crew.

Another object is to provide an offshore drilling vessel with means to transport a riser from one location to another in a safe manner during normal or inclement weather conditions, or to allow the maintenance and repair of the normal riser support mechanisms.

A further object of the invention is to provide a riser braking apparatus which is simple in design, rugged in construction, and economical to manufacture.

The various features of novelty which characterize the invention are pointed out with particularity in the claims next to and forming a part of this disclosure. For a better understanding of the invention, its operating advantages and specific object obtained by its uses, reference shou ld be made to the accompanying drawing and descriptive matter in which there are illustrated preferred embodiments of the invention.

BRIEF DESCRIPTION OF THE DRAWINGS

FIG. I is a schematic representation of the riser braking clamp apparatus, with a riser shown positioned through the center of an offshore vessel and secured to a subsea wellhead assembly.

FIGS. II and IIA are schematic representations of the riser braking clamp apparatus, with load transfer, frames being used to transfer load from the lower end of the braking apparatus to the vessel structure.

Figure 1:
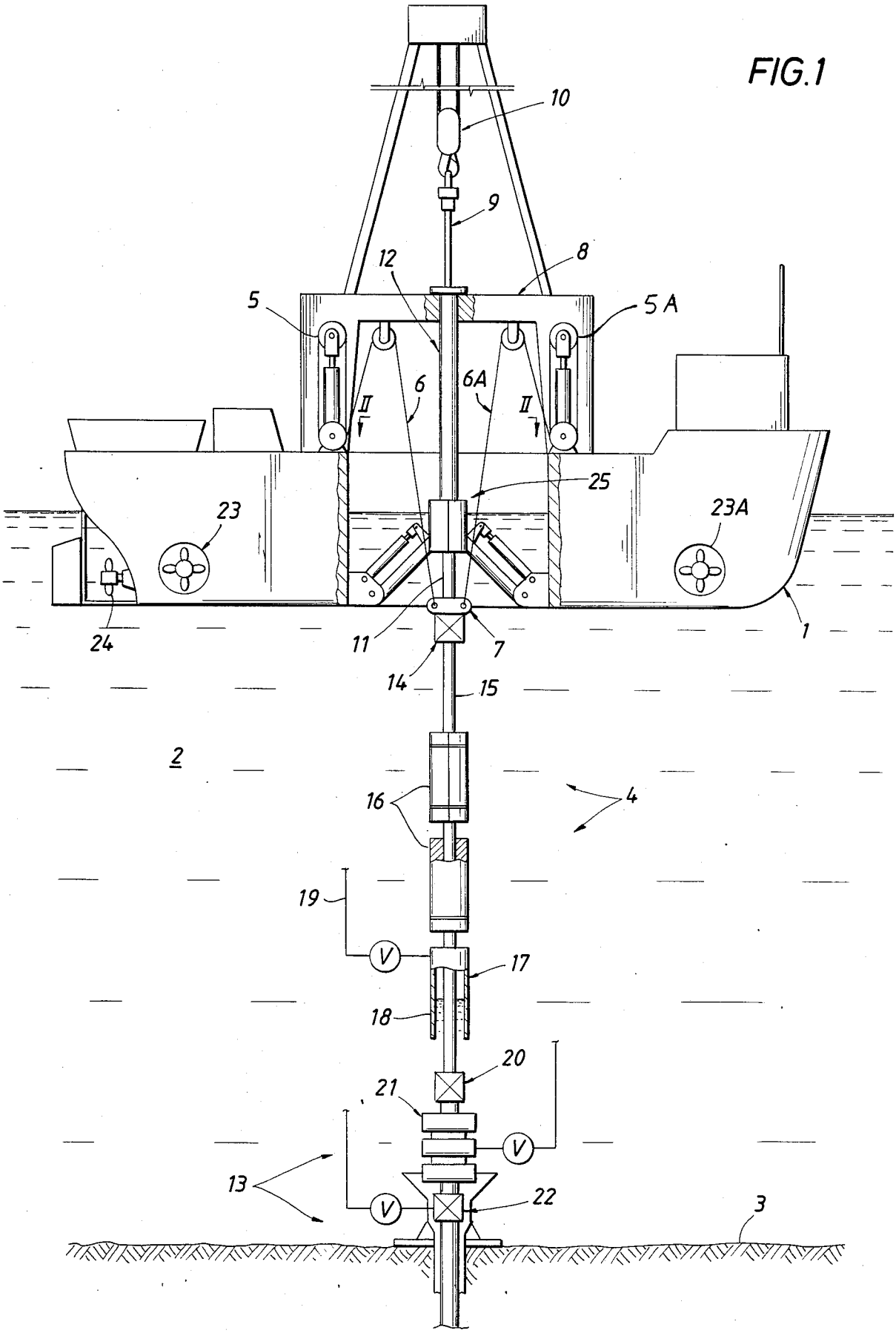
Figure 3:
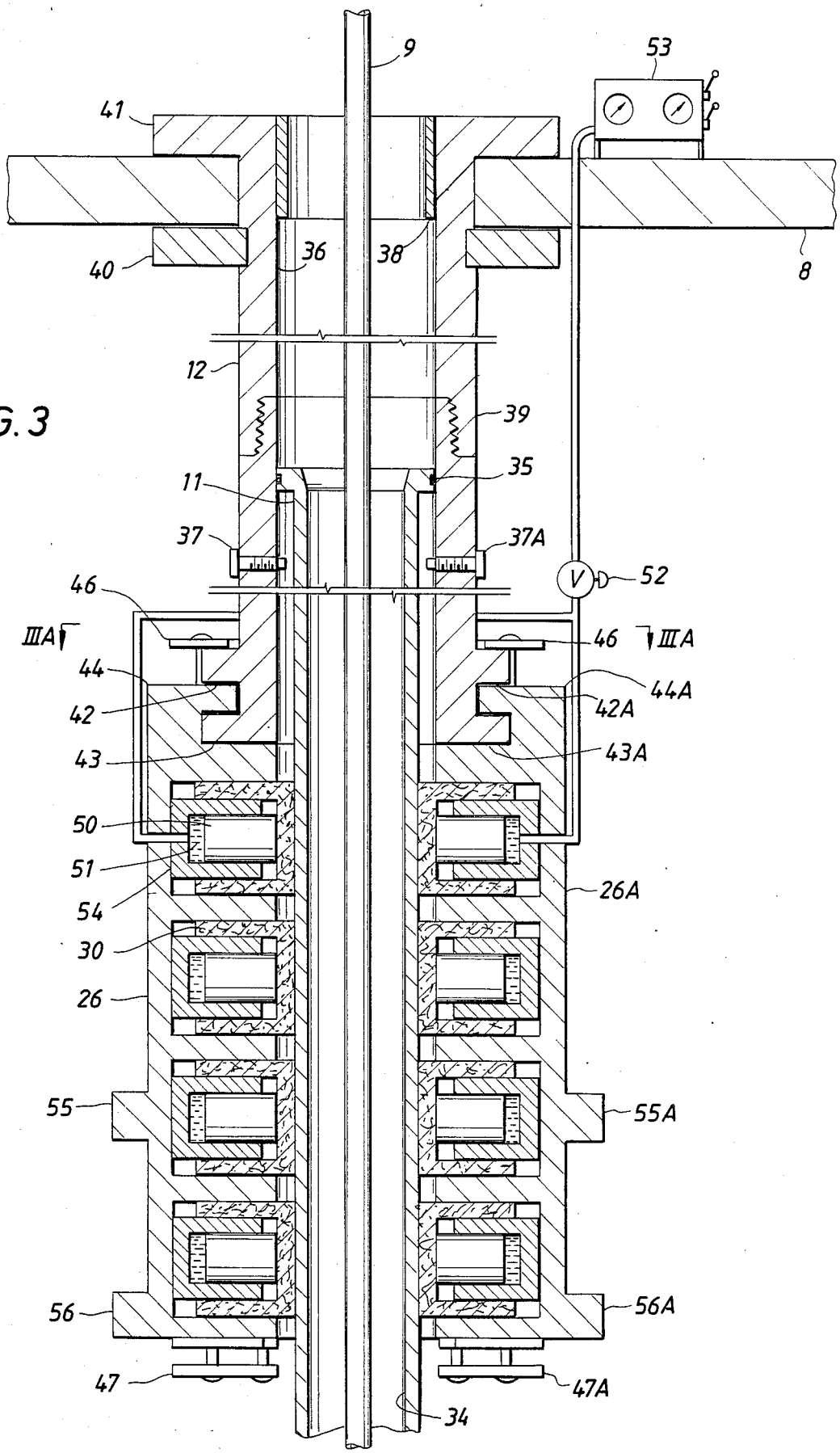

FIGS. III and IIIA are schematic representations which show the friction elements that are carried by the riser outer barrel in contact with the riser inner barrel.

DESCRIPTION OF THE PREFERRED EMBODIMENT

FIG. I shows an offshore drilling vessel 1 floating in a body of water 2 above the ocean floor 3 with a riser 4 connected between the ocean floor 3 and the riser motion compensating and tensioning means 5, 5A of the vessel 1. The motion compensation and tensioning apparatus 5, 5A, connected to the riser 4 by means of tensioner cables 6, 6A and tensioner spider 7, allows the riser 4 to move vertically in a controlled manner within the centrally positioned hull opening of the vessel 1 and also applies an upward force to the riser 4 in order to stabilize and prevent buckling of the riser 4. Personnel positioned on the derrick floor 8 by use of the drill string 9 conduct drilling operations through the riser 4 down to the subsea formation located beneath the ocean floor 3, utilizing the drill string lifting mechanism 10. The motion of the vessel 1 relative to the riser 4 upper elements is compensated by telescopic joint means having a first and second member, the first member consisting of a riser inner barrel 11 which telescopically moves in sliding engagement within a second member consisting of a riser outer barrel 12. This movement allows the drilling operations from the derrick floor 8 to proceed at a varying elevation from the ocean floor 3.

Positioned about the riser inner barrel 11 and carried by the lower portion of the riser outer barrel 12 is the riser braking clamp apparatus 25. Actuation of friction elements 30 (FIG. II) mounted coaxially about the riser inner barrel 11 causes the riser inner barrel 11 to cease motion relative to the riser outer barrel 12, which effectively causes movement of the riser 4 upper elements to be stopped relative to the vessel 1. Actuation of these friction elements 30 prevents damage to the vessel 1 or crew due to uncontrolled movement of the riser 4 when released from the wellhead 13.

Furthermore, the continued actuation of these friction elements 30 allows the riser 4, after it has been disconnected, to be clamped and suspended from the vessel 1 and, if desired, to be transported from one location to another, such as to avoid a storm at the original location or to commence drilling or well workover and completion operations at another location. The riser 4 may also be secured beneath the floating vessel 1 from the riser braking clamp apparatus 25 during maintenance operations either on the riser motion compensating and tensioning means 5, 5A, or on the drill string lifting mechanism 10.

The riser braking clamp apparatus 25 may be mounted below the water line of the vessel 1. Submersion of the apparatus 25 in this manner increases the heat dissipation rate from the apparatus 25 during braking operations, as the riser inner barrel 11 is brought to rest within the riser outer barrel 12. It is also recognized that in an alternate embodiment the riser braking clamp apparatus 25 may be carried by the riser inner barrel 11 in order to operatively and selectively engage the riser outer barrel 12.

Positioned below the riser braking clamp apparatus 25 is a flexible coupling 14 which allows the riser 4 to bend below the bottom of the floating vessel 1 without contacting the vessel 1, thereby preventing harmful stresses in the riser 4, as the vessel 1 moves above the wellhead assembly 13 in response to the sea, and during riser 4 towing operations.

Below the flexible coupling 14 is a series of riser 4 sections comprising syntactic foam float elements 16 or adjustable buoyancy chambers 17 attached to the outer surface of the riser 4, or plain sections 15 with no flotation. The buoyancy chambers 17 are capable of having ballast 18 such as water added or removed from them. Increasing the buoyancy of the riser 4 averts compressive failure of the riser 4 lower elements when connected to the wellhead assembly 13. Decreasing the buoyancy reduces the upward vertical forces or "bobbing" tendencies of the riser 4 when the riser 4 is disconnected from the wellhead 13. Buoyancy adjusting control means 19 such as control valves well known to the art operated from the offshore vessel 1 are capable of controlling the ballast 18 that is added or removed from the buoyancy chambers 17. The drill string 9 can also be placed within the riser 4 sections for additional ballast while the riser 4 is suspended from the vessel 1 or during towing operations of the riser 4. The length of the riser 4 may also be altered before the commencement of towing operations, by the addition or removal of riser sections 15, 16 or 17.

Another flexible coupling 20 is located at the lower end of the riser 4 just above the wellhead assembly 13, which allows the upper portions of the riser 4 to bend relative to the wellhead assembly 13 due to vessel 1 surface movement caused by wind, wave, and tide conditions. Typically located below the flexible coupling 20 and incorporated with the riser 4 is a blowout preventer 21 and a wellhead connection means 22, both well known to the art.

Directional positioning thrusters 23, 23A are incorporated below the water line of the floating vessel 1 and are used in conjunction with the main thrusters 24 to maintain the vessel 1 in a fixed position over the wellhead 18, thus overcoming normal wind, wave, current, and tide forces imposed upon the floating vessel 1. The main thrusters 24 are also used for movement of the floating vessel 1 from one location to another.

As shown in FIGS. II, IIA, III and IIIA, a two-part brake element 26 and 26A is shown holding friction elements 30 closed about the riser inner barrel 11. In a preferred embodiment a plurality of brake elements 26 are spaced circumferentially about the riser inner barrel 11. If two elements 26, 26A are used, then the elements 26, 26A will preferably be spaced opposite each other about said riser inner barrel 11. Extending below the brake element housing 26, 26A is the riser inner barrel 11, the tensioner spider 7, the flexible coupling 14, and the riser 4. Four tensioner cables 6, 6A, 6B, 6C are shown attached to the tensioner spider 7 in order to provide upward lift forces from the motion-compensation apparatus 5, 5A (shown in FIG. 1), to the upper elements of the riser 4.

Though the present invention is primarily directed towards the mounting and actuation of friction elements 30 carried by braking elements 26, 26A so as to brake and clamp between the riser inner and outer barrels 11, 12 to one another, a load transfer system may be included to transfer the resulting braking loads into the vessel 1 structure itself. Load transfer frames 27, 27A are shown operatively engaged between the vessel 1 and the riser brake apparatus 25, as shown in FIGS. II and IIA. The engagement of load transfer frames 27, 27A between the vessel 1 and brake elements 26, 26A allows the efficient transfer of the vertical braking load directly to the vessel 1, at the same time causing an increase in the stabilization of the braking apparatus 25 to lateral movements of the riser 4. The engagement of load transfer frames 27, 27A may be accomplished by means well known to the art, such as by actuation of frame prime mover means 28, 28A which causes movement of the load transfer frames 27, 27A about frame pins 29, 29A carried by frame pivots 31, 31A.

As shown in FIGS. II, IIA the tensioner cables 6, 6A, 6B, 6C connect to the tensioner spider 7 located below the riser braking clamp apparatus 25. The riser 4 continues upward above the tensioner spider 7 to connect with the riser inner barrel 11, which is radially surrounded at the upper end by the riser outer barrel 12. During normal operation, the riser inner barrel 11 telescopes freely within the riser outer barrel 12 in order to compensate for variations in the vessel's 1 distance from the ocean floor 3. When the riser 4 is disconnected at its lower end, however, actuation of the friction elements 30 carried by the brake elements 26, 26A that are connected to the riser outer barrel 12 causes the cessation of movement of the riser inner barrel 11 within the riser outer barrel 12.

As shown in more detail in FIG. III the drill string 9 passes through a drill string throughbore 34 defined along the longitudinal axis of the riser inner barrel 11. A fluid seal 35 carried by the upper elements of the riser inner barrel 11 contacts the riser inner barrel throughbore 36, which is defined along the longitudinal axis of the riser outer barrel 12. This fluid seal 35 may be constructed and fabricated from any material well known to the art, in order to prevent drilling fluid (not shown) carried by the riser outer barrel 12 and riser inner barrel 11 from coming into contact with the friction elements 30. The riser inner barrel lower travel stop 37, 37A and the riser inner barrel upper travel stop 38 are carried by the riser outer barrel 12 on opposite sides of the fluid seal 35 in order to prevent movement of the riser inner barrel 11 below the lower travel stops 37, 37A or to extend upwardly through the riser outer barrel 12. The riser outer barrel 12 may be constructed to any desired length by the use of threaded pipe sections connected by pipe thread connectors 39, as is well known to the art, and is typically operatively connected to the vessel 1.

The riser outer barrel 12 is prevented from upward or downward vertical movement relative to the vessel 1 by installation of riser outer barrel upward movement stop means 40 below the derrick floor 8 and riser outer barrel downward movement stop means 41 formed from the mounting flange of the riser outer barrel 12. It is well recognized that other devices may be used to accomplish the same mechanical result.

Brake elements 26, 26A are shown carried by the upper brake shoulder 42, 42A and the lower brake shoulder 43, 43A formed by the lower elements of the riser outer barrel 12. An attachment shoulder 44, 44A carried at the upper end of brake elements 26, 26A prevents vertical movement of the brake elements 26, 26A relative to the riser outer barrel 12, when the shoulders 44, 44A are engaged between shoulders 42, 42A, 43, 43A. It is recognized, of course, that brake elements 26, 26A may be incorporated entirely or unitized within the riser outer barrel structure 12 in an alternate embodiment of the riser brake apparatus 25, by means well known to the art.

Upper latch arm means 46, 46A and a lower latch arm means 47, 47A are used to latch each respective brake element 26, 26A to one another in order to form a unitized braking structure about the riser inner barrel 11. Other means of connection of the brake elements 26, 26A to each other may also be used, such as by bolting the elements 26, 26A together.

In a preferred embodiment each brake element 26, 26A may include hydraulically-actuated friction element prime move means to move each friction element 30 into contact with the riser inner barrel 11. For example, as shown in FIGS. III and IIIA, one end of a piston 50 is shown in contact with a friction element 30 due to pressurized hydraulic fluid 51 that has been supplied to the other end of the piston 50 via control valve 52 from the control panel 53 carried upon the derrick floor 8. Piston 50 is free to move within cylinder 54 as is well known to the art. A similar array of pistons 50 which drive friction elements 30 may be used in numbers sufficient to guarantee the application of sufficient braking force to the riser inner barrel 11. Friction element 30 may be constructed of any suitable braking material known to the art, such as sintered metal impregnated within a composition pad material.

In operation, when the riser 4 is still connected to the wellhead 13, the riser inner barrel 11 will move a distance approximately equal to the vertical displacement of the vessel 1 from the ocean floor 3. Prior to a planned disconnection from the wellhead 13 ballast 18 is added to the buoyancy chambers 17 carried by the riser 4. A nominal amount of braking effort is applied by the friction elements 30 to the outer surface of the riser inner barrel 11 at this time. At the moment of disconnection, the amount of pressure applied to these friction elements 30 is increased sufficiently to dampen and arrest motion of the riser inner barrel 11 relative to the riser outer barrel 12, which thereby causes the riser inner barrel 11 to be locked to the riser outer barrel 12. It can be seen that one operator (not shown) using the control panel 53 can effectively lock the upper elements of the riser 4 relative to the vessel 1.

Upper load shoulders 55, 55A and lower load shoulders 56, 56A are shown carried by the outer surface of the brake elements 26, 26A in order to form cooperating load transfer members with the load transfer frames 27, 27A. When the upper end of load transfer frame 27 is positioned between the upper and lower load shoulders 55, 56 a portion of the braking load may be transferred through the load transfer frame 27 to the vessel 1, as mentioned earlier.

The braking system may be designed such that sufficient braking force is supplied to the riser inner barrel 11 by brake elements 26, 26A diametrically opposed to one another on opposite sides of the riser inner barrel 11. Although two brake elements 26, 26A are shown in the preferred embodiment, it is realized that other geometric configurations may also be used to accomplish the same mechanical result.

Many other variations and modifications may be made in the apparatus and techniques hereinbefore described, by those having experience in this technology, without departing from the concept of the present invention. Accordingly, it should be clearly understood that the apparatus and methods depicted in the accompanying drawing and referred to in the foregoing description are illustrative only and are not intended as limitations on the scope of the invention.

I claim as my invention:

1. For use in a floating vessel having a substantially centrally positioned vertical hull opening therethrough, said vessel being provided with well drilling equipment, including an elongated vertical riser, said riser extending in tension down through said hull opening to a point adjacent the ocean floor, and motion-compensating and tensioning means carried by said vessel operatively connected to said riser for tensioning said riser during normal operations, the invention comprising:

riser braking clamp apparatus located substantially within the hull opening through the vessel, said riser braking clamp apparatus comprising:

telescopic joint means having a first member and a second member, each member having a lower end and an upper end and an axial throughbore, said lower end of said first member operatively connected to said upper end of said riser, said upper end of said first member slideably engaged with said lower end of said second member, said second member operatively connected to said vessel; and brake means carried by one member of said telescopic joint means, operatively and selectively engageable with said other member of said telescopic joint means, to dampen, arrest, and prevent further movement of said first member relative to said second member of said telescopic joint means.

2. The apparatus of claim 1 wherein:

said first member of said telescopic joint means forms a riser inner barrel having a tubular section forming a drill string throughbore along the longitudinal axis thereof;

said second member of said telescopic joint means forms a riser outer barrel having a tubular section forming a riser inner barrel throughbore along the longitudinal axis thereof, said riser outer barrel operatively connected to said vessel; and said brake means carried coaxially by said riser outer barrel, operatively and selectively engageable with said riser inner barrel to dampen, arrest, and prevent further movement of said riser inner barrel relative to said riser outer barrel.

3. The apparatus of claim 2 wherein said brake means includes a plurality of brake elements, spaced circumferentially about said riser inner barrel, each brake element having:

a friction element carried by said brake element engageable with a portion of the riser inner barrel to arrest movement of said riser inner barrel relative to said riser outer barrel.

4. The apparatus of claim 3 wherein said brake element includes hydraulically-actuated friction element prime mover means to move said friction element into contact with said riser inner barrel.

5. The apparatus of claim 2 wherein said riser outer barrel includes:

upper travel stop means for said riser inner barrel, carried by said upper end of said riser outer barrel adjacent said riser inner barrel throughbore;

lower travel stop means for said riser inner barrel, carried by said lower end of said riser outer barrel adjacent said riser inner barrel throughbore, upward movement stop means for said riser outer barrel, carried by the upper elements of said riser outer barrel to prevent upward movement of said riser outer barrel relative to said vessel, and downward movement stop means for said riser outer barrel, carried by the upper elements of said riser outer barrel to prevent downward movement of said riser outer barrel relative to said vessel.

6. The apparatus of claim 2 wherein said riser inner barrel further includes fluid seal means carried adjacent the upper end of said riser inner barrel, to prevent drilling fluids from contacting said brake means.

7. The apparatus of claim 2 wherein said brake means includes at least one pair of brake elements spaced opposite each other about said riser inner barrel, each brake element having a friction element carried by said brake element engageable with a portion of the riser inner barrel to arrest movement of said riser inner barrel relative to said riser outer barrel.

8. For use in a floating vessel having a substantially centrally positioned vertical hull opening therethrough, said vessel being provided with well drilling equipment, including an elongated vertical riser, said riser extending in tension down through said hull opening to a point adjacent the ocean floor, and motion-compensating and tensioning means carried by said vessel operatively connected to said riser for tensioning said riser during normal operations, the invention comprising:

riser braking clamp apparatus located substantially within the hull opening through the vessel, said riser braking clamp apparatus comprising:

telescopic joint means having a first member and a second member, each member having a lower end and an upper end and an axial throughbore, said lower end of said first member operatively connected to said upper end of said riser, said upper end of said first member slideably engaged with said lower end of said second member, said second member operatively connected to said vessel, said first member of said telescopic joint means forming a riser inner barrel having a tubular section forming a drill string throughbore along the longitudinal axis thereof, said second member of said telescopic joint means forming a riser outer barrel having a tubular section forming a riser inner barrel throughbore along the longitudinal axis thereof, and brake means carried coaxially by said riser outer barrel, operatively and selectively engageable with said riser inner barrel to dampen, arrest, and prevent further movement of said riser inner barrel relative to said riser outer barrel, said brake means including a plurality of brake elements, spaced circumferentially about said riser inner barrel, each brake element having a friction element carried by said brake element engageable with a portion of said riser inner barrel to arrest movement of said riser inner barrel relative to said riser outer barrel, and wherein each brake element further includes latch arm means carried on the outer surface of each brake element, operatively engageable with each adjacent brake element, to operatively connect each brake element to each adjacent brake element.

9. For use in a floating vessel having a substantially centrally positioned vertical hull opening therethrough, said vessel being provided with well drilling equipment, including an elongated vertical riser, said riser extending in tension down through said hull opening to a point adjacent the ocean floor, and motion-compensating and tensioning means carried by said vessel operatively connected to said riser for tensioning said riser during normal operations, the invention comprising:

riser braking clamp apparatus located substantially within the hull opening through the vessel, said riser braking clamp apparatus comprising:

telescopic joint means having a first member and a second member, each member having a lower end and an upper end and an axial throughbore, said lower end of said first member operatively connected to said upper end of said riser, said upper end of said first member slideably engaged with said lower end of said second member, said second member operatively connected to said vessel, said first member of said telescopic joint means forming a riser inner barrel having a tubular section forming a drill string throughbore along the longitudinal axis thereof, said second member of said telescopic joint means forming a riser outer barrel having a tubular section forming a riser inner barrel throughbore along the longitudinal axis thereof, and brake means carried coaxially by said riser outer barrel, operatively and selectively engageable with said riser inner barrel to dampen, arrest, and prevent further movement of said riser inner barrel relative to said riser outer barrel, said brake means including a plurality of brake elements, spaced circumferentially about said riser inner barrel, each brake element having a friction element carried by said brake element engageable with a portion of said riser inner barrel to arrest movement of said riser inner barrel relative to said riser outer barrel, and wherein said brake elements operatively engage load transfer frames carried by said vessel, to transfer a portion of the braking loads through said load transfer frames to said vessel.

* * * * *